United States Patent [19]

Schmidt

[11] 4,290,467

[45] Sep. 22, 1981

[54] RECLOSABLE FILM PLASTIC BAGS AND METHOD OF MAKING SAME

[75] Inventor: John Schmidt, Copenhagen, Denmark

[73] Assignee: Minigrip, Inc., Orangeburg, N.Y.

[21] Appl. No.: 88,090

[22] Filed: Oct. 24, 1979

[30] Foreign Application Priority Data

Mar. 20, 1979 [DE] Fed. Rep. of Germany ..... 2910851

[51] Int. Cl.[3] ..... B65D 27/20

[52] U.S. Cl. ..... 150/3; 53/455; 206/459; 206/806; 493/198; 493/214

[58] Field of Search ..... 150/3; 206/459, 806; 93/35 R; 53/455, 450, 452

[56] References Cited

U.S. PATENT DOCUMENTS

| | | | |
|---|---|---|---|
| 2,146,308 | 2/1939 | Maxfield . | |
| 2,878,849 | 3/1959 | Lingenfelter | 150/3 |
| 3,198,228 | 8/1965 | Naito | 150/3 |
| 3,815,317 | 6/1974 | Toss | 53/451 |
| 3,827,472 | 8/1974 | Uramoto | 150/3 |
| 4,000,768 | 1/1977 | Siegel | 150/3 |

*Primary Examiner*—Donald F. Norton

*Attorney, Agent, or Firm*—Hill, Van Santen, Steadman, Chiara & Simpson

[57] ABSTRACT

A reclosable film plastic hang-up and/or identification pocket merchandise contents display bag has front and rear walls joined at sides and bottom and provides an openable top with complementary separable fastener profiles on the walls across the openable top with a fastener-opening front pull flange that is substantially shorter than its rear fastener-opening pull flange. A panel is joined to the front of the rear pull flange to provide therewith a plural thickness header having, if required, matching hang-up holes through the panel and rear pull flange. A header reinforcing bead structure secures the upper edges of the panel and the rear pull flange together. The panel and rear pull flange define therebetween a downwardly opening pocket adapted to house identification means. A method of making the bag from plastic extrusion is disclosed.

31 Claims, 9 Drawing Figures

RECLOSABLE FILM PLASTIC BAGS AND METHOD OF MAKING SAME

This invention relates to reclosable film plastic hang-up merchandise contents display bags and method of making same, and is more particularly concerned with such bags adapted to support contents of substantial weight.

Merchandise contents display bags have been popular in recent years, especially in self-service stores for displaying for sale small parts in relatively small numbers such as hardware items, of which nuts, screws, washers, and the like are representative.

Heretofore, bags of this type have often been provided with headers consisting of folded over strip material secured across the tops of the bags and provided with a hang-up hole by which the bag could be hung on a hook for merchandise display purposes. The header strip was adapted to contain various information printed or stamped thereon, such as merchandise and source identification, pricing, etc. Bags having the prior structure are exemplified in U.S. Pat. No. 2,146,308. A disadvantage of such prior bags is that the header required assembling a separate header strip with the bag material, and the strip has generally been of a different material. For example where the bag is of a plastic film material, the header has generally been made from paper stapled or otherwise fastened to the bag. In general, also, such bags have not been reclosable, but have required tearing the header from the bag leaving the bag open and the contents unprotected even if it is desired to store part of the contents in the bag after the bag has been opened.

While it would be advantageous from a cost standpoint to make the bags entirely from extruded plastic material, including the header structure, a drawback has been that the plastic film of the header structure, even if made of double ply has tended to sag under the weight of contents, especially hardware contents. Not only is such sagging unsightly, but where the bag is of the reclosable fastener type sagging is undesirable due to the sag strain on the fastener. As shown in U.S. Pat. No. 4,000,768, it has been proposed to equip the top of the bag with separately formed handle of sufficient width to prevent sagging in cooperation with a transverse reinforcing bead below the handle. However, that is an expensive multi-part construction and requires special handling and equipment for manufacture, so that the bags are uneconomical for display and sale of low cost products such as hardware items of the type mentioned, especially if the bags mentioned are small. There is also need for a low cost plastic bag which may or may not have hang-up means, but is equipped with pocket means to receive selective identification means such as printed cards.

It is therefore an important object of the present invention to provide a simple, low cost, efficient reclosable film plastic hang-up and/or identification pocket merchandise contents display bag and method of making the same which will permit utilization of high speed bag making apparatus.

Another object of this invention is to provide a new and improved hang-up and/or identification pocket merchandise contents display bag which can be made from a one piece integral extrusion to provide all parts of the bag, including bag body, reclosable fastener means and hang-up/pocket header, with hang-up hole means where desired and which will resist sagging when hung on a hanger extending through the hole.

Another important object of the present invention is to provide a new and improved parts contents bag, which can be made from a one piece integral extrusion, to provide all parts of the bag, including bag body, reclosable fastener means and a part identification pocket into which a part description can be inserted and changed whenever the part in the bag is changed; and a method of making the bag which will permit utilization of high speed bag making apparatus.

In keeping with the foregoing and other objects of the invention, there is provided a reclosable film plastic hang-up and/or identification pocket merchandise contents display bag having front and rear walls joined at least at side edges and providing an openable top for the bag. Complementary separable fastener profiles are provided on the walls across the openable top and adapted to be separated from a closed condition into an opened condition. A fastener-opening front pull flange extends up from the fastener profile on the front wall. A fastener-opening rear pull flange, substantially longer than the front pull flange, extends up from the fastener profile on the rear wall. A panel on the front of the rear pull flange provides therewith a plural thickness header for the bag. The panel has its sides secured to the rear pull flange, and a lower edge of the panel is adjacent to but free from the front pull flange. Matching hang-up holes, if required, are provided through the panel and the rear pull flange adjacent to the upper edges thereof. A header reinforcing bead structure above the holes secures the upper edges of said panel and the rear pull flange together and stiffens the header against sagging under the weight of package contents when the bag is hung on a hanger extending through the hang-up holes. The bead structure may be a fastener profile assembly to facilitate high speed production. Whether or not the header has hang-up hole means, the rear pull flange and the attached panel are adapted to provide therebetween a downwardly opening pocket within which identification means may be housed.

The invention also provides a new and improved method of making bags having the foregoing structure.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure and in which.

Figure 1:
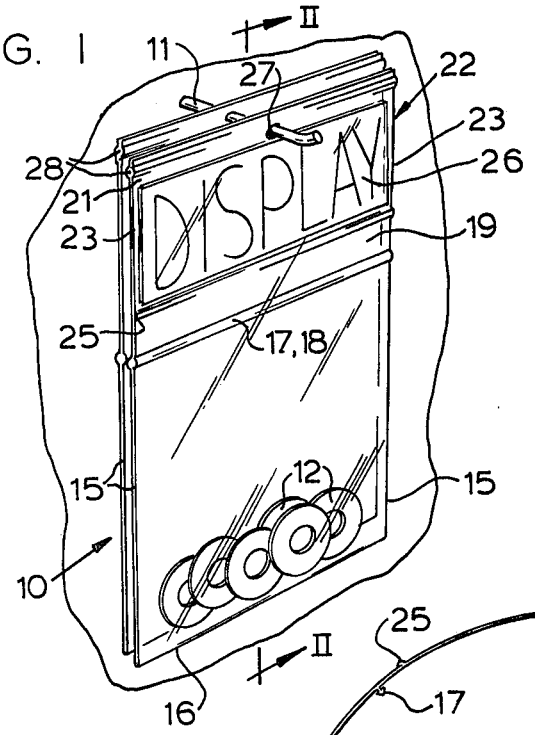
FIG. 1 is a perspective view of bags embodying the present invention and showing the same hung on a hanger.

Reclosable film plastic merchandise contents display bags 10 (FIGS. 1 and 2) may be adapted to be hung on a hanger 11 for sales display of contents such as small hardware items 12. Bags for this purpose may be on the order of 3 to 4 inches wide and 6 or 7 inches long. Each bag has a front wall 13 and a rear wall 14. The front and rear walls are joined at closed side edges 15 and a closed bottom edge 16. Complementary separable fastener profiles 17 and 18 on the walls 13 and 14, respectively, are disposed across an openable top of the bag and are adapted to be separated from a closed condition into an opened condition. To facilitate opening, a fastener-opening front pull flange 19 extends up from the fastener profile 17 and cooperatively a fastener opening rear pull flange 20, substantially longer than the front pull flange 19, extends up from the fastener profile 18. A panel 21 on the front of the rear pull flange 20 provides therewith a plural thickness header 22 for the bag. The panel 21 has its opposite sides 23 secured to the rear pull flange 20, and a lower edge 24 of the panel 21 is located adjacent to, but preferably free from the front pull flange 19. Desirably, the front pull flange has at or adjacent to and along its upper edge, a narrow reinforcing bead 25 to facilitate gripping the pull flange 19.

To accommodate the hanger 11, the panel 21 and the rear pull flange 20 may have adjacent to their upper edges, means comprising matching hang-up holes 27. Above the holes 27, a header reinforcing rib structure 28 is provided securing the upper edges of the panel 21 and the rear pull flange 20 together and stiffening the header 22 against sagging under the weight of the package contents 12 when the bag is hung on the hanger 19.

Although the header 22 may be only long enough, that is longer than the front pull flange 19, to accommodate the holes 27 and the reinforcing rib 28, in the preferred construction shown, the header is of substantial width, so that the panel 21 may be imprinted on its inside or outside surface with desirable information such as merchandise source, merchandise description, price information, advertising, or the like.

In addition, by having the panel 21 and the rear pull flange 20 of sufficient width, they are adapted to provide an identification housing pocket 29 therebetween in the header 22 and into which access may be had through the open lower edge of the panel 21. This permits identification indicia or information imprinted on a card 26 or the like, to be inserted and retained within the pocket 29. Such an arrangement provides for convenient mass production of the bags 10 without imprint, if desired, for sale to customers who may wish to supply their own information cards, or for whom such cards can be supplied on a private label basis. This is especially desirable for diverse small volume or variable volume merchandise. The information or identification cards are adapted to be produced at lower cost than the bags and for low volume products afford unlimited versatility with a standard unprinted bag.

Figure 3:
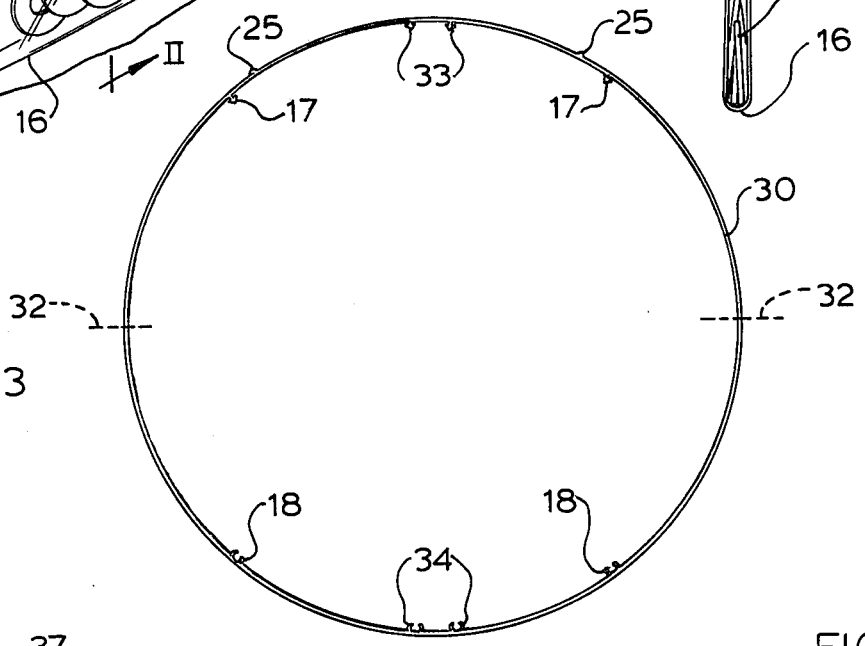
FIG. 3 is a view showing a one piece plastic extrusion adapted for economically simultaneously producing two strips of bag blanks embodying the invention.

High speed mass production of the bags 10 is adapted to be accomplished, for example, by providing a tubular extruded plastic film 30 (FIG. 3) from which a pair of bag blank strips 31 (FIG. 4) can be conveniently produced at the same time. To this end, the tubular extrusion 30 is provided interiorly thereof with the fastener profiles 17 and 18 preferably integrally extruded in one piece therewith, and located properly in longitudinally extending spaced parallel relation. The rear wall profiles 18 are provided at complementary longitudinal lines opposite the respective profiles 17. Location of the profiles 17 and 18 is such that when the extrusion 30 is folded along a median diametrical fold line 32 between the opposed profiles 17 and 18, the complementary profiles 17 and 18 for each of the bag blank strips 31 will be brought together into closed fastener relationship.

In a convenient, economical and efficient manner of forming the reinforcing ribs 28 for the bag blank strips 31, secondary extruded complementary fastener profiles 33 and 34 are provided by adjacent spaced parallel pairs at the proper locations between the profiles 17 and 18 at each side of the extrusion 30 to mate when the extrusion is flattened. As a result, the joined fastener profiles 17 and 18 as well as the joined fastener profiles 33 and 34, not only maintain the parts of the folded extrusion 30 in proper orientation, but the joined profiles also provide convenient rib rails for tracking the collapsed bag making extrusion through processing apparatus, for, among other things, converting the collapsed extrusion 30 into the bag strips 31.

Figure 4:
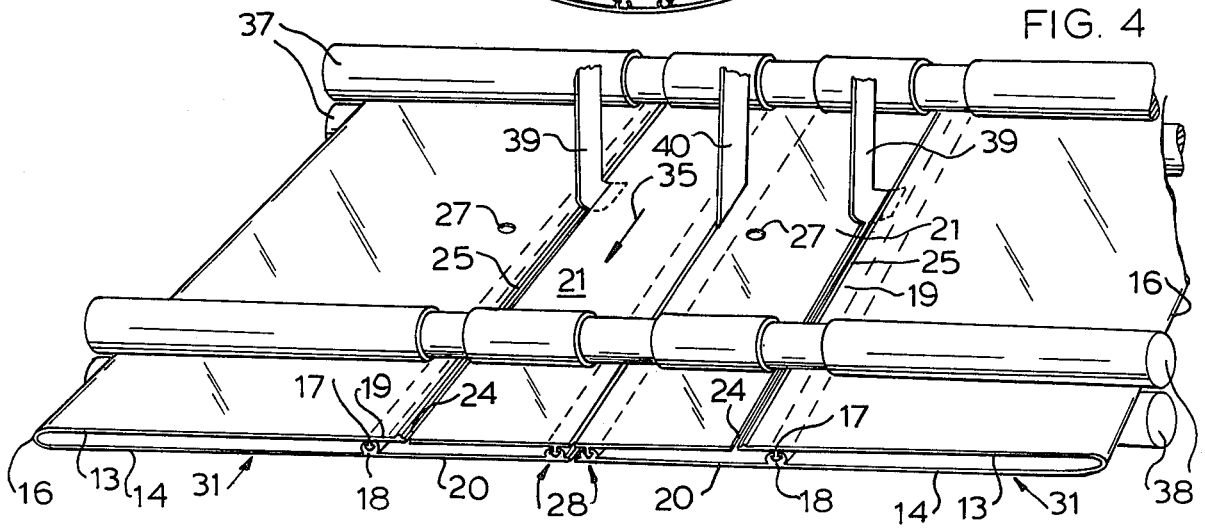
FIG. 4 is a schematic illustration showing a method of converting the extrusion of FIG. 3 into a pair of bag blank strips.

By way of example, the collapsed extrusion may be advanced, as indicated by directional arrow 35 in FIG. 4, between spaced sets of driven grooved rotary tracking rollers 37 and 38 wherein the closed closure profiles 17 and 18 and the rib profiles 33 and 34 track in complementary grooves of the rollers 37 and 38 for maintaining accurate straight-on advance of the bag material, as well as accurately maintaining a correct relationship between the front panels 21 and the rear pull flanges 20 after separation of the narrow pull flanges 19 from the front panel portions 21 of the extrusion by means of slitters 39. It will be readily understood that at high speed the relationship would otherwise be difficult to maintain, because of the flexibility of the thin film plastic bag material. At the same time, the two bag blank strips 31 are separated by means of a slitter 40.

At preferably a convenient location upstream from the slitter station represented by the slitters 39 and 40, suitable punching means (not shown) punch when required, the hang-up holes 27 in the two bag blank strips. The punched and separated bag blank strips 31 may be rolled up on reels of suitable volume for storage or transportation to bag filling apparatus. On the other hand, in a large volume bagging operation, the separated bag blank strips 31 may be fed directly to bag filling apparatus.

Figure 5:
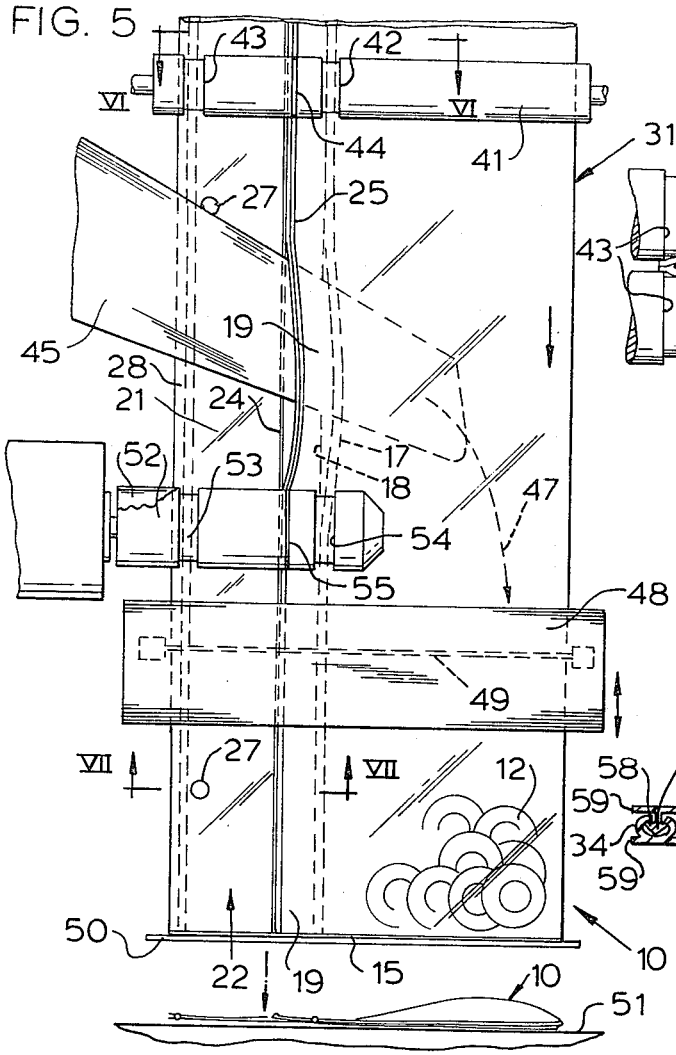
FIG. 5 is a schematic illustration showing how the bag strips are adapted to be filled and then separated by bag sections.

In bag filling apparatus, such as schematically illustrated in FIG. 5, one of the bag blank strips 31 is fed through guide means comprising a cooperative pair of guide rollers 41 engaging the strip 31 therebetween and having aligned guide grooves 42 tracking the rib provided by the fastener 17, 18. Concurrently aligned guide grooves 43 in the rollers 41 track the rib provided by the fastener 33, 34. A shallow clearance groove 44 in the roller 41 which opposes the face of the strip 31 having the pull flange reinforcing bead 25, accommodates that bead. Through this arrangement, the strip 31 is accurately guided toward a filling nozzle 45.

In a desirable form, the filling nozzle 45 is constructed and arranged to extend diagonally downwardly into the bag strip 31 at a location downstream and below the guide rollers 41 to project into the contents receiving area of the bag blank strip 31, through the slit between the pull flange 19 and the adjacent edge 24 of the front panel 21, and between the fastener profiles 17 and 18 which are progressively separated by the nozzle 45 as the strip 31 advances. Predetermined quantities of the preferred bag contents 12 are discharged from the nozzle 45 at suitable timed bag filling intervals as indicated by the directional arrow 47. Such filling intervals are controlled in timed relation to bag sealing and advancing means of any preferred construction, as exemplified in the beforementioned U.S. Pat. No. 2,146,308. Such means may comprise a gripping and pull down device 48 and heat sealing means 49, by which the strip 31 is progressively sealed thereacross to provide the sealed side edges 15 for the successive filled bags 10, and the filled bag sections being advanced a bag section at a time. Each filled and sealed bag section may then be separated from the strip 31 as by means of a tear-off or cut-off device 50, and the separated bags 10 received on a receiver 51, such as a conveyor, receptacle, or the like. Downstream from the nozzle 45 and upstream from the pull down and sealing means 48, 49, means are provided for refastening the fastener profiles 17, 18, and accurately guiding the bag blank strip 31 downwardly toward the pull down and sealing means 48, 49, herein comprising cooperating rollers 52 having cooperating aligned tracking grooves 53 trackingly receiving the bag upper end rib 28. Similarly tracking grooves 54 in the rollers 52 cooperate to receive the profiles 17 and 18, rejoining the profiles into closed fastener condition, and tracking the resulting rib in strip guiding relation. A shallow groove 55 in the roller 52 which engages the front of the bag blank strip 31 clears the bead 25.

Figure 7:
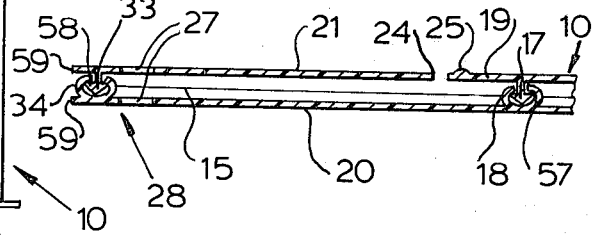
FIG. 7 is an enlarged fragmentary sectional detail view taken substantially along the line VII—VII of FIG. 5.

As best seen in FIG. 7, after the bag sections have been completed, the relationship of the fastener profiles 17 and 18 and the rib profiles 33 and 34 is such that although the fastener provided by the profiles 17 and 18 can be opened reasonably easily, the rib fastener provided by the profiles 33 and 34 is very difficult to open and will therefore fairly securely resist separation. This is desirable because the principal function of the rib 28 is for manufacturing guidance and ultimately hang-up reinforcement and/or top closure for the pocket 29. To attain the desirable result of differential resistance to separability of the respective sets of fastener profiles, the principle best disclosed in U.S. Pat. No. 3,198,228 is preferably employed. That is, the male fastener 17 is of arrowhead shape in cross-section with the side of the profile which is toward the inside of the bag 10 providing a somewhat wider, larger prong 57, and that side of the female profile 18 providing a complementary groove of matching size, as compared to the opposite side of the fastener where the male profile prong is narrower and relatively smaller and that side of the female profile similarly fashioned. This provides substantially greater resistance to opening of the fastener by pressures exerted from inside the bag and lesser resistance to digital opening of the profile by manipulation of the pull flange 19, relative to the pull flange 20.

On the contrary, while the male profile 33 of the rib fastener 28 is also of arrowhead shape in cross-section, it has a wider and larger side prong 58 which is at the top or outward side of the profile, and the female profile 34 is of complementary shape, so that the greatest resistance to separation of the profiles 33 and 34 is relative to vestigal flanges 59 where the bag blank was separated from the head-to-head bag blank derived from the collapsed multi-bag extrusion. As a result even if some separating force may be applied to the vestigal flanges 59, the particular orientation of the fastener profiles 33 and 34 will strongly resist separation. Since the front panel 21 is of substantial length and has its sides fixedly secured to the sides of the elongate rear pull flange 20, there is little likelihood of a separating force being applied to the rib fastener 28 by way of the panel 21 and the flange 20.

Figure 6:
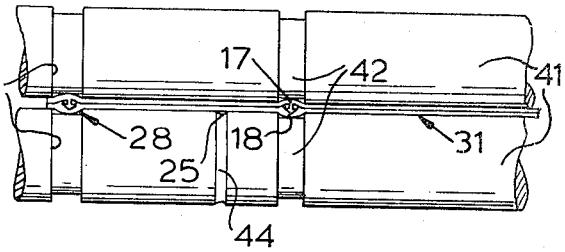
FIG. 6 is an enlarged fragmentary sectional plan view taken substantially along the line VI—VI of FIG. 5.
Figure 8:
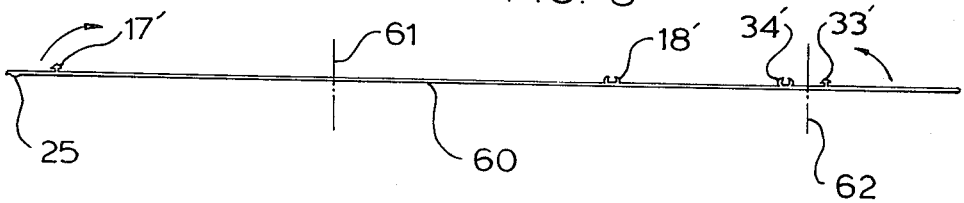
FIG. 8 is a schematic illustration of a flat one piece extrusion adapted for producing a single bag blank strip.
Figure 9:
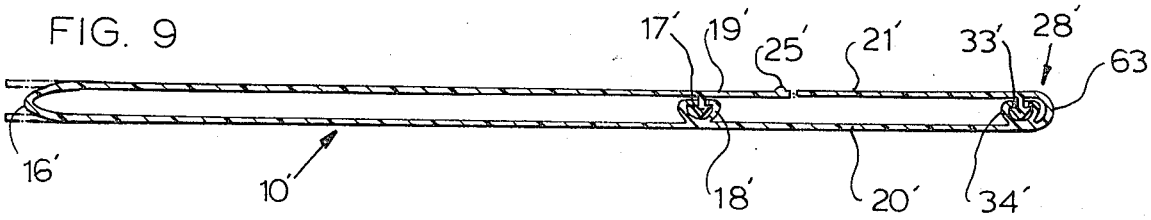
FIG. 9 is a transverse sectional detail view showing the bag blank derived from the extrusion of FIG. 8.

If preferred, the bag blank strips may be fashioned as best seen in FIGS. 8 and 9 from a unitary extruded single flat strip 60, on which the separable closure profiles 17' and 18' for the bag and the reinforcing rib closure profiles 33' and 34' are all located on one face of the extruded blank strip 60 and properly aligned so that when the flat extrusion is folded along a line 61, the profiles 17' and 18' will match and close the bag pouch area. When the profiles 33' and 34' are brought into registration by folding along a line 62 therebetween, the reinforcing rib 28' results and the front panel 21' lies in opposed relation to the elongate rear pull flange 20' and has its edge adjacent to the edge of the short front pull flange 19' having thereon the reinforcing bead 25'. In this instance, the very narrow portion 63 of the web between the profiles 33' and 34' need not be trimmed away, but will serve to encase the outer side of the rib 28' as a protective barrier against separation of the profiles 33' and 34', and also enhance the reinforcing value of the rib 28'. Filling of the bag 10' may be effected in similar fashion as described in connection with FIGS. 5 and 6.

If preferred, of course, the bag 10' may be formed from a tubular extrusion and the pull flange 19' separated from the adjacent edge of the front panel 21' by slitting means such as the slitters 39 shown in FIG. 4.

Where it is desired to imprint directly on the bags 10 or 10', the reinforcing rib 28 or 28', as well as the rib which in turn is provided by the separable closure fasteners comprising the profiles 17 and 18 or 17' and 18' will serve conveniently as track means for guiding the bag blank strip material through the printing apparatus. To facilitate such printing, at least those areas of the bag material to be imprinted may be treated to facilitate receiving the printing ink.

Where the weight of the contents to be supported by the bags in hang-up position is such that there may be unusual strain on the reinforcing rib 28, the profile elements 33, 34 may be adhesively secured together or welded together.

If it is preferred to provide bags which can be filled from the bottom end instead of through the separable closure as described in connection with FIG. 5, the bag 10' in FIG. 9 is well suited for the purpose. In such case, the bag 10' may be made from an extrusion in which the panel 21' is joined at its lower edge to the upper edge of the front pull flange 19', as indicated in dash outline in FIG. 9, with desirably a weakening along the joint, so that when it is desired to gain access into the bag, the line of weakening can be broken. This provides an ideal tamperproof bag. For such a tamperproof bag, the filling of the bag may be effected through the bottom end 16' which for this purpose, will be opened as by splitting where the bag 10' as modified is made from a tubular extrusion, but which will be in the first instance separated where the bag is made from a flat extrusion. After the bag has been filled through its bottom end, the bottom end is permanently sealed, as is customary practice with bags which are designed to be loaded through their bottom ends.

Figure 2:
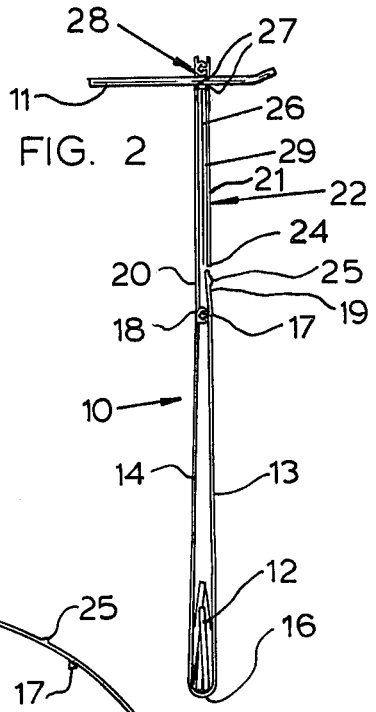
FIG. 2 is a vertical sectional view taken substantially along the line II—II of FIG. 1.

It may also be noted that the bag 10' in FIG. 9 is illustrated without a hang-up hole, since for some purposes, such hang-up hole may not be needed. However, the bag does have a pocket between the panel 21' and the rear pull flange 20' into which may be selectively inserted a display or identification member such as a card 26 (FIGS. 1 and 2).

It will be understood that variations and modifications may be effected without departing from the spirit and scope of the novel concepts of this invention.

I claim as my invention:

1. A reclosable film plastic merchandise contents display bag having front and rear walls joined at least at closed sides and providing an openable top for the bag, comprising:

complementary separable fastener profiles on said walls across said openable top and adapted to be separated from a closed condition into an opened condition;

a fastener-opening front pull flange extending up from the fastener profile on said front wall;

a fastener-opening wall rear pull flange, substantially longer than said front pull flange, extending up from the fastener profile on said rear wall;

a panel on the front of said rear pull flange and providing therewith a plural thickness header for the bag;

said panel having its sides secured to said rear pull flange and a lower edge of said panel being separable relative to said front pull flange;

matching hang-up holes through said panel and said rear pull flange adjacent to the upper ends thereof;

and a header reinforcing rib structure above said holes securing the upper ends of said panel and said rear pull flange together and stiffening the header against sagging under the weight of package contents when the bag is hung on a hanger extending through said hang-up holes.

2. A bag according to claim 1, wherein said panel and said rear pull flange provide a downwardly opening pocket.

3. A bag according to claim 2, including a display card housed in said pocket, said panel being transparent, so that the card can be viewed therethrough.

4. A bag according to claim 1, wherein said header reinforcing rib structure comprises fastener profiles joined together.

5. A bag according to claim 4, wherein said profiles have means to restrain separation thereof.

6. A bag according to claim 5, wherein said separation restraining means comprises a connecting web portion encasing the outer side of the profile rib.

7. A bag according to claim 5, wherein said restraining means secure said reinforcing rib profiles permanently against separation.

8. A bag according to claim 1, including a reinforcing bead adjacent to the edge of said front pull flange.

9. A reclosable film plastic bag having front and rear walls joined at least at closed side edges and providing an openable top for the bag, comprising:

complementary separable fastener profiles on said walls across said openable top and adapted to be separated from a closed condition into an opened condition;

a fastener-opening front pull flange extending up from the fastener profile on said front wall;

a fastener-opening rear pull flange, substantially longer than said front pull flange, extending up from the fastener profile on said rear wall;

a panel on the front of said rear pull flange and providing therewith a plural thickness header for the bag;

said panel having its sides secured to said rear pull flange and a lower edge of said panel being separable relative to said front pull flange;

and a header reinforcing rib structure securing the upper ends of said panel and said rear pull flange together and closing the top of a pocket between said panel and said rear pull flange.

10. A bag according to claim 9, including a display card housed in said pocket, said panel being transparent, so that the card can be viewed therethrough.

11. A method of making a reclosable film plastic merchandise contents display bag, comprising:

providing front and rear walls;

joining said walls at least along side edges;

forming complementary separable fastener profiles on said walls across an openable top of the bag, whereby the bag is adapted to be opened by separation of said profiles from a closed condition into an opened condition;

providing a fastener-opening front pull flange extending up from the fastener profile on said front wall;

providing a fastener-opening rear pull flange, substantially longer than said front pull flange, extending up from the fastener profile on said rear wall;

providing a panel on the front of said rear pull flange and securing sides of said panel to sides of said rear pull flange to provide therewith a plural thickness header for the bag, the lower edge of said panel being adjacent to but separable from said front pull flange;

providing matching hang-up holes through said panel and said rear pull flange adjacent to the upper ends of the panel and rear pull flange;

and forming a header reinforcing rib structure above said holes and thereby securing the upper ends of said panel and said rear pull flange together and stiffening the header against sagging under the weight of package contents when the bag is hung on a hanger extending through said hang-up holes.

12. A method according to claim 11, comprising providing between said panel and said rear pull flange, a downwardly opening pocket.

13. A method according to claim 12, which comprises forming at least said panel from transparent material, and inserting a display card in said pocket.

14. A method according to claim 11, comprising forming complementary coupling fastener profiles on the upper ends of said rear pull flange and said panel, and coupling these profiles to provide said header reinforcing bead structure.

15. A method according to claim 14, which comprises providing said profiles with means to restrain separation thereof.

16. A method according to claim 15, comprising providing said means to restrain separation in the form of a connecting web portion encasing the outer side of the profile rib.

17. A method according to claim 14, comprising securing said reinforcing rib profiles permanently against separation.

18. A method according to claim 11, comprising providing said front pull flange adjacent to its top edge with a reinforcing bead.

19. A method according to claim 11, which comprises forming all of the identified parts of the bag in a one piece extrusion in which said separable fastener profiles, and profiles for forming said header reinforcing bead structure, are located in spaced parallel relation to one another, and folding the extrusion and joining said separable fastener profiles with one another and joining said reinforcing bead structure profiles with one another.

20. A method according to claim 19, which comprises forming said extrusion in a strip, and after said folding, sealing the strip transversely thereacross and thereby joining said walls along said side edges and securing the sides of said panel to sides of said rear pull flange.

21. A method of making a reclosable film plastic bag, comprising:

providing front and rear walls;

joining said walls along at least side edges;

forming complementary separable fastener profiles on said walls across an openable top of the bag, whereby the bag is adapted to be opened by separation of said profiles from a closed condition into an opened condition;

providing a fastener-opening front pull flange extending up from the fastener profile on said front wall;

providing a fastener-opening rear pull flange, substantially longer than said front pull flange, extending up from the fastener profile on said rear wall;

providing a panel on the front of said rear pull flange and securing sides of said panel to sides of said rear pull flange to provide therewith a plural thickness header for the bag, the lower edge of said panel being adjacent to but separable from said front pull flange;

and forming a header reinforcing rib structure that secures the upper ends of said panel and said rear pull flange together and thereby forming a pocket between said panel and said rear pull flange.

22. A method of making and filling reclosable film plastic merchandise contents display bags, comprising:

providing a continuous bag blank strip having a portion providing front and rear bag walls joined along a bottom edge, complementary separable fastener profiles on said walls across an openable top of the bag, a fastener-opening front pull flange extending up from the fastener profile on said front wall, a fastener opening rear pull flange extending up from the fastener profile on said rear wall, a portion providing a panel on the front of said rear pull flange and having a lower edge separable relative to the upper edge of said front pull flange, a header reinforcing bead structure securing the upper ends of said panel and said rear pull flange together;

guiding and running said strip downwardly through bag filling apparatus including cross sealing the lower end of the strip closed;

inserting a filling nozzle between the separated edges of said panel and said front pull flange, and extending the nozzle between said separable fastener profiles to the interior of the bag;

from said nozzle, filling bag contents into a bag section above the lower cross sealed end of said strip;

cross sealing across the strip at a predetermined height above said sealed lower end and thus closing a filled bag section;

and separating the filled bag section from the strip.

23. A method according to claim 22, which comprises using said header reinforcing bead and said fastener profiles in closed condition as track means in effecting said guiding and running.

24. A method of making reclosable film plastic bags, comprising:

forming a tubular extrusion having at opposite sides interiorly thereof complementary separable fastener profiles substantially spaced and having therebetween closely spaced complementary reinforcing and connecting rib profiles;

collapsing said extrusion and joining said complementary separable fastener profiles from opposite sides of the extrusion together and also joining said complementary rib profiles from the opposite sides of the extrusion together;

slitting one side of the collapsed extrusion longitudinally at locations between the joined fastener profiles and the joined rib profiles but closer to the joined fastener profiles;

and separating the collapsed extrusion between said joined rib profiles into a pair of similar bag blank strips adapted to be run through bag sealing apparatus.

25. A method according to claim 24, which comprises utilizing said joined rib profiles as track means during said slitting.

26. A method of making reclosable film plastic bags, comprising:

forming a plastic film strip with a first separable fastener profile on one face longitudinally adjacently spaced from one edge of the strip to define between said one edge and said first profile a bag front pull flange;

forming a complementary second profile longitudinally on said face of the strip sufficiently spaced from said first profile to provide a bag body when the strip is folded longitudinally to join said profiles;

providing a pair of third and fourth profiles adjacently spaced from one another and spaced from said second profile a distance to provide a rear pull flange area and free panel area;

folding said strip longitudinally midway between said first and second profiles and joining said first and second profiles in separable fastener relation;

and folding said strip longitudinally midway between said third and fourth profiles and joining said third and fourth profiles to provide a reinforcing rib;

and in said folding moving said front pull flange area and said free panel area into overlapping relation to said rear pull flange area.

27. A method of making reclosable film plastic bags, comprising:

forming a plastic film strip with a first longitudinal separable fastener profile on one face;

forming a complementary second longitudinal profile on said face of the strip sufficiently spaced from said first profile to provide a bag body when the strip is folded longitudinally to join said profiles;

providing substantially spaced from said first and second profiles a pair of third and fourth profiles adjacently spaced from one another;

folding said strip longitudinally and joining said first and second and said third and fourth profiles in separable fastener relation, whereby the folded strip provides relatively narrow areas between said joined first and second profiles and said joined third and fourth profiles and provides a substantially longer bag body extending from said joined first and second profiles in the opposite direction relative to said relatively narrow areas.

28. A reclosable film plastic bag comprising:

a bag pouch body having an openable top;

a separable closure tongue and groove fastener across said openable top;

said separable fastener having means for substantial resistance to separation of the fastener by forces from inside the pouch body and means offering less resistance to separation of the fastener by force applied from outside said openable top;

a top structure on the bag body having a reinforcing bead comprising a tongue and groove fastener profile assembly including means offering substantial resistance to separation of the profile assembly by forces thereon from outside the bag.

29. A bag according to claim 28, wherein said separable fastener comprises a male profile of arrow head shape in cross section with the side of the profile which is toward the inside of the bag having a somewhat wider, larger prong fitting into a complementary female profile groove of matching size and the opposite side of the male profile and the complementary female profile being narrower and relatively smaller, and said bead profile assembly comprising a male profile of arrow head shape in cross section having a somewhat wider larger top side prong fitting into a complementary female profile groove of matching size and the opposite side of the male profile and the complementary female profile being narrower and relatively smaller so as to provide substantial resistance to separation of the bead profile assembly from the outside of the bag.

30. A method of making a reclosable film plastic bag, comprising:

forming a bag pouch body with an openable top;

providing on said body a separable closure tongue and groove fastener across said openable top;

providing said separable fastener with means for substantial resistance to separation of the fastener by forces from inside the pouch body and means offering less resistance to separation of the fastener by force applied from outside said openable top;

providing said body with a top structure and a reinforcing bead on the top structure comprising a tongue and groove fastener profile assembly and providing said assembly with means offering substantial resistance to separation of the profile assembly by forces thereon from outside the bag.

31. A method according to claim 30 comprising providing said separable fastener tongue in substantially arrow head shape profile with a substantially larger prong extending toward the inside of the bag and a smaller prong toward the outside of the bag to provide said substantial resistance and less resistance relationship, and providing said bead profile assembly with a tongue of substantially arrow head shape in cross section transversely across the axis of the bead profile assembly and having a substantially larger prong on the upper side of the bead profile tongue to offer the substantial resistance to separation by forces from outside the bag.

* * * * *